United States Patent [19]

Russell, deceased et al.

[11] 4,175,520

[45] Nov. 27, 1979

[54] DISTRIBUTOR ASSEMBLY

[76] Inventors: Albert C. Russell, deceased, late of Belleair, Fla.; Mary K. Russell, administratrix, One Eastwood La., Belleair, Fla. 33516

[21] Appl. No.: 869,524

[22] Filed: Jan. 16, 1978

[51] Int. Cl.[2] ..... F02P 5/04

[52] U.S. Cl. ..... 123/117 A

[58] Field of Search ..... 123/117 A, 117 R

[56] References Cited

U.S. PATENT DOCUMENTS

| | | | |
|---|---|---|---|
| 2,643,304 | 6/1953 | Lautzenhiser | 123/117 A |
| 2,646,781 | 7/1953 | Doyen | 123/117 A |
| 2,778,892 | 1/1957 | Vanderpoel | 123/117 A |
| 3,057,938 | 10/1962 | Perry | 123/117 A |
| 3,457,905 | 7/1969 | Jukes | 123/117 A |
| 3,561,411 | 2/1971 | Vasilescu | 123/117 A |
| 4,095,568 | 6/1978 | Furukawa | 123/117 A |

*Primary Examiner*—Ronald B. Cox

*Attorney, Agent, or Firm*—Gifford, Chandler, VanOphem, Sheridan and Sprinkle

[57] ABSTRACT

A spark ignition distributor assembly having air density compensating means is provided for use with an internal combustion engine. A first distributor plate is rotatably mounted between a first and second position within a housing while a second distributor plate in turn is rotatably mounted between a first and second position on and coaxial with the first distributor plate. A distributor shaft is rotatably journalled in the housing and extends coaxially through both distributor plates. An actuator connected to the shaft selectively actuates a make-and-break switch mounted on the second plate. The rotational position of one of the plates is controlled by the manifold vacuum of the engine while the rotational position of the other plate is controlled substantially by the density of the incoming air to the engine via appropriate sensing devices.

8 Claims, 3 Drawing Figures

DISTRIBUTOR ASSEMBLY

BACKGROUND OF THE INVENTION

I. Field of the Invention

The present invention relates generally to distributor assemblies for internal combustion engines and, more particularly, to such a distributor assembly with air density compensation means.

II. Description of the Prior Art

Spark ignition internal combustion engines conventionally include a distributor having a housing secured to the engine. A distributor shaft is rotatably journalled through the distributor housing and has one end coupled for rotation in synchronism with the engine crankshaft.

A distributor plate is pivotally or rotatably mounted within the interior of the housing between a first and second rotational position while make-and-break switch means are mounted onto the distributor plate. The switch means in turn cooperate with a cam or other means secured to the rotor to selectively actuate the switch means upon rotation of the distributor shaft. The rotational position of the distributor plate is conventionally controlled by a vacuum advance connected to the intake manifold vacuum of the engine.

The previously known rotatable distributor plate in conjunction with the intake manifold vacuum control effectively advances or retards the spark in response to the intake manifold vacuum of the engine which is indicative of engine load and speed conditions. These previously known engine distributor assemblies, however, include no provision whatsoever for controlling the spark advance or retardation for the engine combustion in response to the density of the incoming air to the engine. The density of the air, which of course is dependent upon the temperature, pressure and moisture content of the air, affects the combustion charactristics o the air/fuel mixture which is supplied to the engine. Consequently, the failure of these previously known distributor assemblies to adjust the spark advance or retardation in order to accommodate varying air densities has resulted in improper combustion, which in turn, results in increased air pollution and fuel wastage.

SUMMARY OF THE PRESENT INVENTION

The distributor assembly of the present invention overcomes the above mentioned disadvantages of the previously known distributor assemblies by providing a distributor assembly with automatic means for adjusting the spark advance and retardation in accordance with the air density of the incoming air to the engine.

In brief, the spark ignition distributor assembly according to the present invention comprises a housing in which a first distributor plate is rotatably mounted between a first and second rotational position. However, unlike the previously known distributor assemblies, a second distributor plate is rotatably mounted between a first and second rotational position with respect to the first distributor plate. Both distributor plates can rotate independently of each other within the distributor housing.

A distributor shaft is rotatably journalled in the housing and extends coaxially through both of the distributor plates. Actuating means, such as a cam, are secured to the upper end of the distributor shaft which selectively actuates a make-and-brake switching means attached to the second distributor plate. By this arrangement the amount or degree of spark advance or retardation is dependent upon the sum rotational position of the two distributor plates.

The position of the first distributor plate is controlled by at least one and preferably three elements which are responsive to the air density. For example, the elements may comprise a temperature sensing element, a pressure sensing element and a moisture sensing element.

The rotational position of the second distributor plate is controlled by a vacuum advance coupled to the intake manifold vacuum pressure as is conventional in the art. The vacuum advance body is connected to the first distributor plate so that the rotational positions of the distributor plates are independent of each other.

As will become hereinafter more clearly apparent, the effective spark advance or retardation of the distributor assembly according to the present invention is varied not only according to the intake manifold vacuum in a manner previously known but also in accordance with the density of the incoming air to the engine. Such compensation of the spark advance or retardation provides a simple, inexpensive and yet effective means for improving the combustion characteristics of the air/fuel mixture within the engine. Improvement of the combustion efficiency not only increases fuel economy and engine power but also decreases the exhaustion of pollutants from the engine.

BRIEF DESCRIPTION OF THE DRAWINGS

A better understanding of the present invention will be had upon reference to the following detailed description when read in conjunction with the accompanying drawing wherein like reference characters refer to like parts throughout the several views, and in which.

DETAILED DESCRIPTION OF THE PRESENT INVENTION

Figure 1:
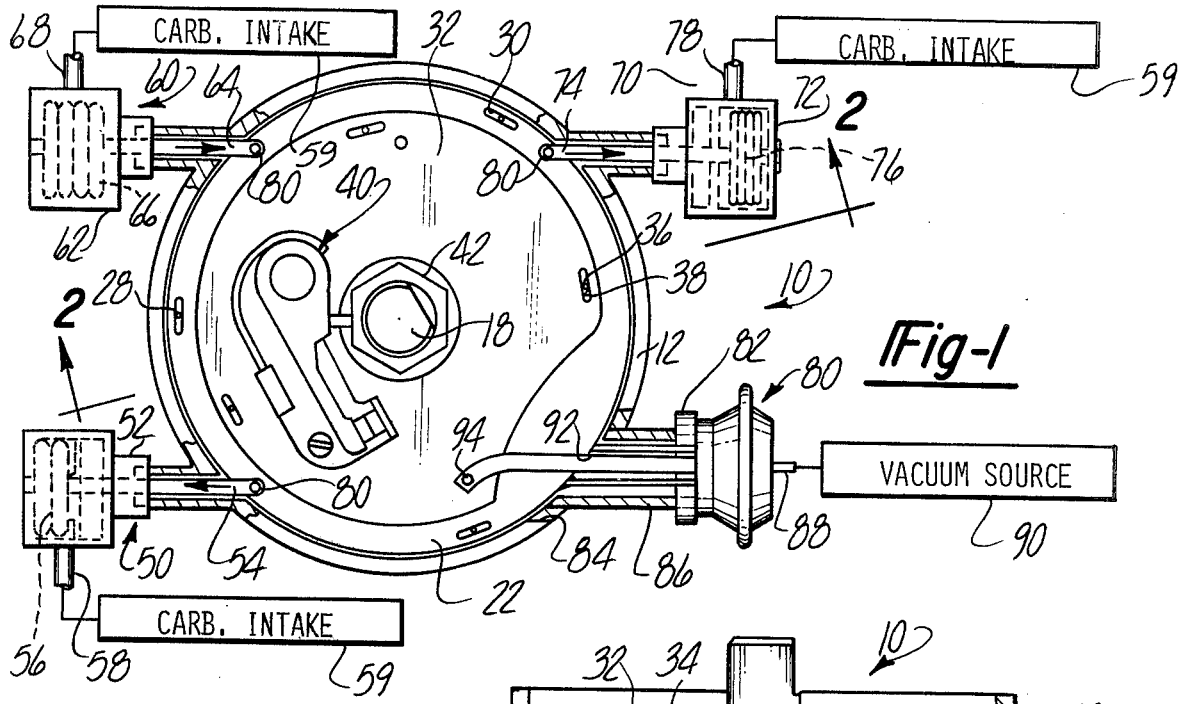
FIG. 1 is a top view illustrating the distributor assembly according to the present invention and with parts removed for clarity.
Figure 2:
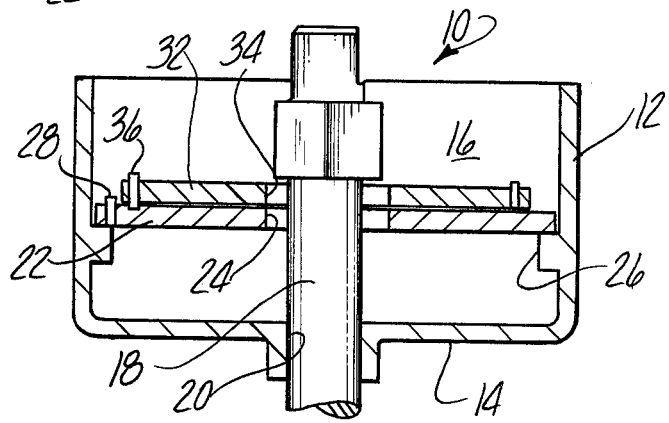
FIG. 2 is a side sectional view showing the distributor assembly according to the present invention taken substantially along line 2—2 and with parts removed from clarity.

With reference first to FIGS. 1 and 2, the distributor assembly 10 according to the present invention is thereshown and comprises a generally tubular and cylinderical housing 12 closed on its lower end 14 and thereby forming an interior cylinderical chamber 16. A distributor shaft 18 extends through an opening 20 in the closed lower end 14 of the housing 12 and is rotatably mounted by appropriate means within the housing 12 and coaxially through the chamber 16. The lower end of the distributor shaft 18 (not shown) is adapted to be coupled to the crankshaft of an internal combustion engine (not shown) for rotation in synchronism with the engine crankshaft. For example, in a four-stroke cycle engine, the distributor shaft 18 conventionally rotates at one-half the rotational speed of the engine crankshaft.

A first annular distributor plate 22 having a central opening 24 is positioned within the housing cylindrical chamber 16 so that the distributor shaft 18 extends coaxially through the opening 24. The first distributor plate 22 is rotatably or pivotally mounted relative to the housing 12 between a first and second rotational position for a reason to become hereinafter apparent. The rotational mounting of the first distributor plate 22 within the housing 12 can be achieved by any conventional means. However, as shown in the drawing, the housing 12 includes an inwardly projecting annular flange 26 with a plurality of circumferentially spaced upwardly extending pins 28. The pins 28, in turn, are positioned through arcuate slots 30 formed about the periphery of the first distributor plate 22 so that the arcuate slot 30 and pin 28 arrangement permits limited rotation of the first distributor plate 22 relative to the housing 12.

A second and substantially annular distributor plate 32 having a central opening 34 is coaxially mounted on top of the first plate 22 so that the upper end of the distributor shaft 18 extends coaxially through and above the central opening 34. The second distributor plate 32 is mounted on the first plate 22 by means which permit rotation of the second plate 32 between a first and second rotational position with respect to the first or lower distributor plate 22. Preferably, the mounting means comprises upwardly extending pins 36 secured to the first or lower distributor plate 22 which extend upwardly through arcuate slots 38 formed in the second plate 32. By this arrangement it can be seen that the net rotational position of the second plate 32 is dependent upon the sum of the rotational positions of both the first and second distributor plates.

Conventional make-and-break ignition switch means 40 are attached to the upper side of the second plate 32 and coact with appropriate actuating means 42, such as a distributor cam, secured onto the upper end of the distributor shaft 18. Although the make-and-break ignition switch means 40 are illustrated in FIG. 1 as a mechanical set of points, it will be understood, of course, that other type of ignition switch means, such as those commonly employed on electronic ignition systems remain within the scope of the invention. Moreover, as is well known in the art, the rotational position of the switch means 40 relative to the housing 12 controls the ignition timing, i.e. the advance or retardation of the spark ignition. Moreover, the conventional components of the spark ignition system, for example the distributor cap, spark plugs, condenser and the like have been omitted from the drawing for clarity.

The rotational position of the first distributor plate 22 is controlled by a first sensor means 50, a second sensor means 60, and a third sensor means 70. Each of the sensor means 50, 60 and 70 includes a housing 52, 62 and 72, respectively, secured to the distributor housing 12. Moreover, each of these sensor means 50, 60 and 70 respectively includes an actuating rod 54, 64 and 74 pivotally coupled by a pin 80 to the first distributor plate 22 at circumferentially spaced positions around the plate 22. Consequently, axial displacement of any or all of the actuator rods 54, 64 and/or 74 cause a net rotation of the first distributor plate 22 relative to the housing 12. It will also be appreciated that since the actuating rods 54, 64 and 74 are somewhat tangential with respect to the distributor plate 22 and of opposite direction, the actuator rods may, in fact, operate against and tend to cancel out each other.

The first sensing means 50 includes the temperature responsive element 56 so that the net axial position of the actuating rod 54 is dependent upon the temperature of the temperature sensing means 56. A conduit 58 may be coupled to a carburetor 59 for the internal combustion engine so that the temperature sensed by the temperature sensing element 56 is representative of the incoming air to the carburetor.

Similarly, the sensor means 60 includes pressure sensing element 66, such as an aneroid bellows, so that the axial position of the actuator rod 64 is dependent on the air pressure surrounding the pressure sensing element 66. As before, a conduit 68 is preferably coupled to the carburetor 59 air intake so that the pressure of the incoming air to the carburetor is communicated to the pressure sensing element 66.

Lastly, the sensor means 70 includes a humidity responsive lement 76 which controls the axial position of the actuator rod 74. As before, the sensor means 70 preferably includes a conduit 78 fluidly connected to the engine carburetor 59 so that the moisture sensing element 76 is responsive to the moisture content of the incoming air to the engine carburetor.

From the foregoing it can be seen that the sensor means 50, 60 and 70 control the rotational position of the first distributor plate 22 via the respective actuator rods in response to the density of the incoming air to the carburetor. Thus, as will be more clearly apparent hereinafter, the means 50, 60 and 70 adjust the overall spark advance or retardation for the engine ignition system in response to the density of the carburetor incoming air. It should also be apparent, that not only the amount but also direction of rotation that such sensing means 50, 60 or 70 effects upon the first distributor plate 22 is dependent upon the ignition characteristics of the particular internal combustion engine.

With reference now particularly to FIG. 1, a vacuum advance means 80 having a housing 82 is disposed through an opening 84 in the distributor housing 12 and connected to the first distributor plate 22 by means of a tubular bracket 86. The opening 84 through the distributor housing 12 is wider than the bracket 86 so that interference between the bracket 86 and the distributor housing 12 during rotation of the first distributor plate 22 is precluded.

The vacuum advance means 80 includes a port 88 conventionally coupled to the intake manifold vacuum 90 of the internal combustion engine. In the well known fashion, the intake manifold 90 controls the axial position of an actuating rod 92 pivotally connected at 94 to the first distributor plate 32. Axial displacement of the actuating rod 92 via the vacuum advance means 80 causes the second distributor plate 32 to rotate or pivot with respect to the first distributor plate 22.

From the foregoing it can be seen that the rotational position of the switch means 40 with respect to the distributor housing 12 is dependent upon the net rotational position of the distributor plates 22 and 32. The rotation of the first distributor plate 22, as previously described, is dependent upon the density of the incoming air to the carburetor while the rotational position of the second distributor plate 32 is more conventionally dependent upon the intake manifold vacuum. Thus, by this simple arrangement, the spark advance and retardation of the engine ignition system is adjusted in accordance with the density of the air to the carburetor for maximum engine efficiency and power and minimum emission pollutants.

Figure 3:
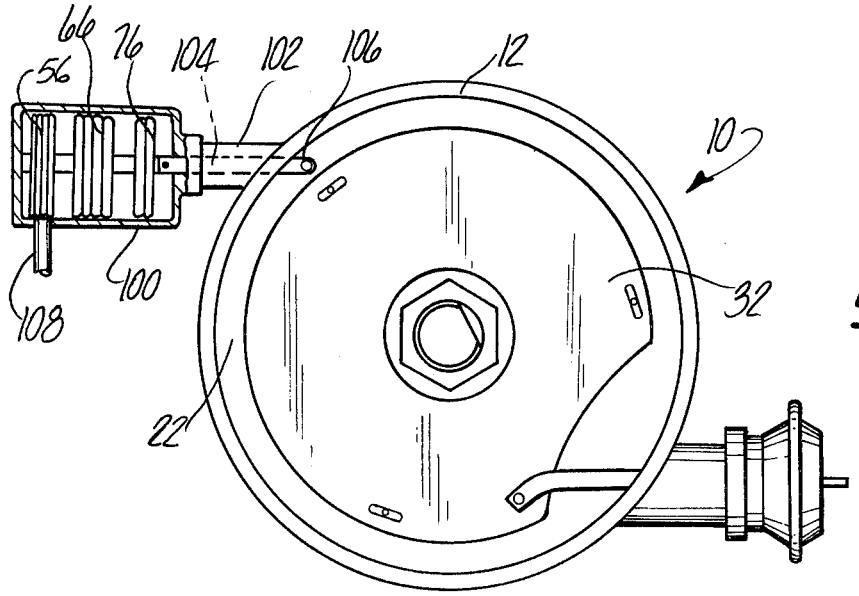
FIG. 3 is a top plan view of the distributor assembly according to the present invention similar to FIG. 1 but showing a modification thereof.

With respect now to FIG. 3, a modification of the invention 10 is thereshown in which the temperature sensing means 56, the pressure sensing means 66 and the moisture sensing means 76 are contained within a single housing 100 which in turn is secured by a tubular bracket 102 to the distributor housing 12. Then sensors 56, 66 and 76 are secured together and control the net axial displacement of a single actuator rod 104. The actuator rod 104, in turn, is pivotally connected at 106 to the first distributor plate 22 in response to the incoming air density to the carburetor. Furthermore, as before, a port 108 open to the interior of the housing 100 is preferably connected with the incoming air to the carburetor so that the sensor elements 56, 66 and 76 are exposed to an environment accurately representing the incoming air to the carburetor. In all other respects, however, the embodiment 10 illustrated in FIG. 3 of the present invention is the same as that shown in FIG. 1 so that further description thereof is deemed unnecessary.

It can, therefore, be seen that the distributor assembly 10 according to the present invention provides a simple inexpensive and yet effective means for controlling the spark advance or retardation of the spark ignition system for an internal combustion engine in response to the air density of the incoming air to the carburetor. This enables more efficient fuel combustion for the internal combustion engine while simultaneously reducing the emission of pollutants and other noxious gases from the engine.

Having described my invention, however, many modifications thereto will become apparent to those skilled in the art to which it pertains without deviation from the spirit of the invention as defined by the scope of the appended claims.

I claim:

1. A distributor assembly for use with an internal combustion engine, said distributor assembly comprising:

a distributor housing, a first distributor plate and means for rotatably mounting said first plate in the housing between a first and second rotational position, a second distributor plate and means for coaxially rotatably mounting said second plate onto said first plate between a first and second rotational positon, switch means mounted to said second plate, a distributor shaft rotatably mounted through said housing and coaxially through said plates and means connected to said shaft for selectively actuating said switch means upon rotation of said shaft, means for controlling the rotational position of one of said plates in response to the manifold vacuum of said engine, and means for controlling the rotational position of the other plate in response to the temperature and pressure of an air source.

2. The invention as defined in claim 1 and further including means for controlling the rotational position of the last mentioned plate in response to the humidity of said air source.

3. The invention as defined in claim 1 wherein said air source is the incoming air to a carburetor operatively associated with said engine.

4. The invention as defined in claim 1 wherein the latter controlling means comprises a temperature sensing element havng an actuating rod, said rod being coupled at one end to said temperature sensing element and connected at its other end to said last mentioned plate, and a pressure sensing element having an actuating rod, said last mentioned actuating rod having one end connected to the pressure sensing element and its other end connected to the last mentioned distributor plate wherein both actuating rods are substantially tangential with respect to the last mentioned distributor plate.

5. The invention as defined in claim 1 wherein said former controlling means comprises a vacuum housing secured to said latter mentioned plate whereby said distributor plates can rotate independently with respect to each other.

6. The invention as defined in claim 1 wherein said last mentioned controlling means comprises a sensor housing secured to said distributor housing, a temperature sensing element secured to a pressure sensing element and both elements being disposed in said sensor housing, one of said elements being secured to the sensor housing while the other element is secured substantially tangentially to the last mentioned plate via an actuating rod.

7. The invention as defined in claim 6 and further including a moisture sensing element coupled to one of the other elements.

8. The invention as defined in claim 3 and including fluid conduit means connected from the incoming air to the carburetor to said last mentioned controlling means.

* * * * *